United States Patent [19]

Glock

[11] Patent Number: 4,893,546

[45] **Date of Patent: * Jan. 16, 1990**

[54] AUTOMATIC PISTOL

[76] Inventor: Gaston Glock, Siebenbürger Strasse 16-12, A-1220 Vienna, Austria

[ * ] Notice: The portion of the term of this patent subsequent to May 2, 2006 has been disclaimed.

[21] Appl. No.: 227,511

[22] Filed: Aug. 2, 1988

Related U.S. Application Data

[63] Continuation of Ser. No. 733,352, Sep. 6, 1985, abandoned, continuation of Ser. No. 456,056, filed as PCT AT82/00015 on Apr. 29, 1982, Pat. No. 4,539,889.

[30] Foreign Application Priority Data

Apr. 30, 1981 [AT] Austria ..... 1944/81

[51] Int. Cl.[4] ..... F41C 19/14

[52] U.S. Cl. ..... 89/145; 89/147

[58] Field of Search ..... 42/65, 69.01, 69.02; 89/139, 145, 147

[56] References Cited

U.S. PATENT DOCUMENTS 2,464,427 3/1949 Wilson ..... 89/139

3,678,800 7/1972 Seidel et al. ..... 89/147

FOREIGN PATENT DOCUMENTS 605729 11/1934 Fed. Rep. of Germany .

*Primary Examiner*—Stephen C. Bentley

*Attorney, Agent, or Firm*—Toren, McGeady & Associates

[57] ABSTRACT

A pistol has a frame, a barrel slidable on the frame and having a cartridge-receiving rear end, and a breech slidable on the frame and engageable over the rear end of the barrel to form a cartridge chamber. A standard slide carries the barrel and breech. A firing element and a firing pin operatively linked thereto are movable on the breech toward and away from the barrel between a rear position in which the firing pin is out of the cartridge chamber and a front position with the firing pin projecting forward into the cartridge chamber for firing a cartridge in the chamber when the firing element moves from the rear to the front position. A relatively strong firing spring braced against the firing element urges same into the front position and a relatively weak spring braced against the firing element urges same into the rear position. A trigger movable on the frame between an actuated and an unactuated position and an abutment engageable with the firing element and displaceable backward on the frame are linked together so as to displace the firing element back into the rear position on displacement of the trigger from the unactuated to the actuated position and to displace the abutment out of operative engagement with the firing element on displacement of the trigger into the actuated position for displacement of the firing element by the springs into the front position.

6 Claims, 9 Drawing Sheets

FIG. 1
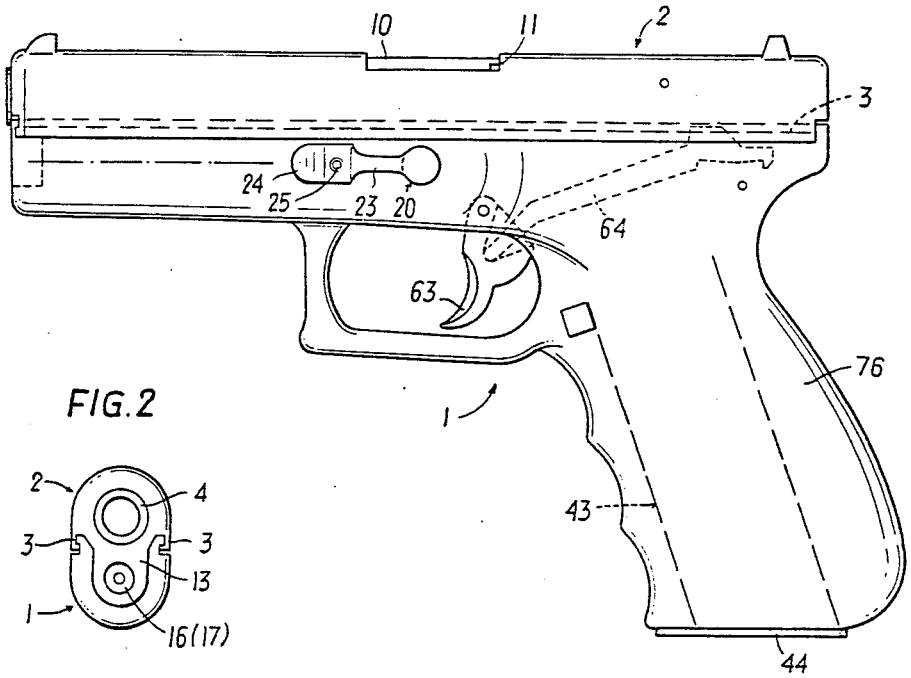
FIG. 2
FIG. 3
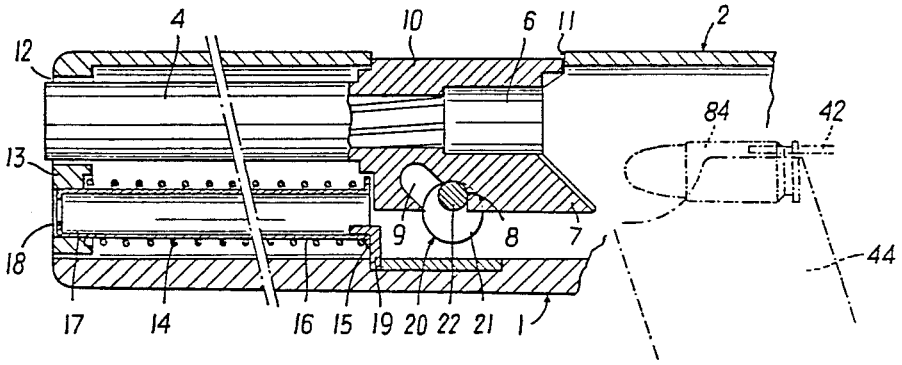
FIG. 4
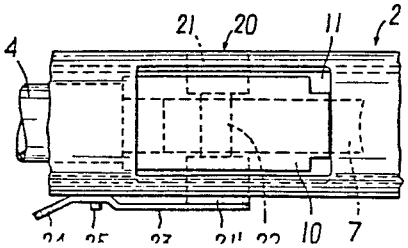

BEST AVAILABLE COP

BEST AVAILABLE COP

BEST AVAILABLE COP

BEST AVAILABLE COP

BEST AVAILABLE COP'

AUTOMATIC PISTOL

CROSS REFERENCE TO RELATED APPLICATION

This is a continuation of application Ser. No. 773,352, filed Sept. 6, 1985, now abandoned, which is in turn a continuation of Ser. No. 456,056, filed as PCT AT 82/00015 on Apr. 29, 1982, now U.S. Pat. No. 4,539,889.

FIELD OF THE INVENTION

The present invention relates to a pistol. More particularly this invention concerns an automatic pistol of the type which automatically ejects the spent casing and chambers a new cartridge after each shot.

BACKGROUND OF THE INVENTION

A standard automatic pistol has a frame provided with a firing mechanism and carrying a slide comprising the barrel and breech block slidable on the frame. A recoil spring is braced between the frame and slide and the breech block is provided with a firing pen operable by a firing pin spring or a hammer loaded by a hammer spring. The firing mechanism has an abutment guided generally parallel to and extending into the path of the firing pin or the hammer. This abutment is connected via a link with the trigger so that on actuation of same it is movable in a direction loading the firing pin or hammer.

Such pistols are relatively complicated to use. To chamber a cartridge it is necessary to pull back and then push forward the slide. Similarly when the cartridge clip is empty, the slide must be pulled back, a new clip inserted, then the slide released and moved forward to chamber the cartridge. All these actions must be carried out against heavy spring forces and in only one sequence, so that such a pistol can only be entrusted to experienced hands.

The shooter cannot often tell whether the pistol is on or off safety, especially after a pause in shooting. Thus it is possible for a shot to be attempted while the safety is on, or for a shot to be loosed inadvertently by someone thinking it is on when it is not.

Trigger-type automatics have a trigger that is cocked by the slide when a cartridge is chambered. In order to carry the loaded pistol with safety, the hammer must be uncocked. Subsequent shooting necessitates manually cocking the hammer by means of the trigger. This procedure requires that quite some force be exerted, necessitating a long trigger stroke without any noticeable critical point. The pistol is off safety after the shot, and subsequent shots only require limited force on and a limited stroke of the trigger, so that the danger of an unintentional shot is great. For safety against jarring and dropping, a particular latch for the firing pin is provided that is released on operation of the trigger before the hammer strikes the firing pin.

In addition, pistols are known with a separate safety lever which is actuated by the three fingers surrounding the pistol grip. It is, however, difficult to move these three fingers independently of the trigger finger so that mistakes in handling happen. In addition, with such a pistol whenever it is solidly gripped it is off safety, so that unintentional shots can be fired.

The known pistols have in common that the firing mechanism holds the firing element, that is, the firing pin or the hammer, in its cocked position and in this position the pistol is off safety and cocked so it is sensitive to jarring or dropping.

Another problem with the known automatic pistols is that removal of the barrel for servicing of the gun is fairly difficult, necessitating tools. In view of the need to maintain such complicated mechanisms carefully, such difficulty is extremely disadvantageous.

Yet another disadvantage of the known automatic pistols is that after the last shot in a clip the slide returns forward on the empty chamber. To chamber a new cartridge it is necessary to pull back the slide, insert the new clip, then advance the slide. In a situation where a pistol is used, such extra handling is very disadvantageous.

OBJECTS OF THE INVENTION

It is therefore an object of the present invention to provide an improved pistol.

Another object is that provision of such an improved pistol which overcomes the above-given disadvantages.

Yet another object is to provide an easy-to-use but very safe automatic pistol which can be produced at low cost.

SUMMARY OF THE INVENTION

A pistol according to the invention has a frame, a barrel slidable on the frame and having a cartridge-receiving rear end, and a breech block slidable on the frame and engageable over the rear end of the barrel to form a cartridge chamber. A standard slide carries the barrel and breech block. A firing element and a firing pin operatively linked thereto are movable on the breech block toward and away from the barrel between a rear position in which the firing pin is out of the cartridge chamber and a front position with the firing pin projecting forward into the cartridge chamber for firing a cartridge in the chamber when the firing element moves from the rear to the front position. A relatively strong firing spring braced against the firing element urges same into the front position and a relatively weak spring braced against the firing element urges same into the rear position. A trigger movable on the frame between an actuated and an unactuated position and an abutment engageable with the firing element and displaceable backward on the frame are linked together so as to displace the firing element back into the rear position on displacement of the trigger from the unactuated to the actuated position and to displace the abutment out of operative engagement with the firing element on displacement of the trigger into the actuated position for displacement of the firing element by the springs into the front position.

According to another feature of this invention, the abutment is engageable with the firing element in an intermediate position thereof in the unactuated position of the trigger and the linkage displaces the firing element backward from the intermediate position into the rear position by means of the abutment on displacement of the trigger from the unactuated to the actuated position.

Thus, the starting position of the abutment for the firing bolt or hammer is at an intermediate location in the travel path of same. In this manner, the firing mechanism can be such that the trigger force is substantially less than with the known pistols. Preferably, the starting position of the firing pin is in a noncritical region of its travel path or that of the hammer, in which region the force of the partially loaded firing pin spring or hammer spring is insufficient to fire a shot.

According to this invention, the spring means includes a relatively strong firing spring braced against the firing element and urging same into the front position and a relatively weak spring braced against the firing element and urging same into the back position. The trigger or cocking force is the difference between these spring forces and can be set at a hair trigger or a relatively stiff novice level. In other words, the pistol is always uncocked or at least partially uncocked. The cocking for each shot is effected by the trigger and is assisted by a spring, so that the condition of the pistol is the same before the first shot as it is before the subsequent shots.

According to another feature of this invention, the firing means includes a guide holding the abutment in operative engagement with the firing element on displacement of the trigger from the unactuated to the actuated position. In addition, when the element is in the intermediate position the abutment prevents any displacement of the firing element relative to the abutment. Accidental discharge of the pistol therefore is impossible.

In accordance with another feature of the invention the abutment is displaceable laterally relative to the firing element between a position in the path of same and engageable therewith and a position out of the path and unengageable therewith, the link means displacing the abutment into the out-of-path position on displacement of the trigger into the actuated position. This movement of the abutment which frees the firing element—firing pin or hammer—in a direction perpendicular to the one in which this element moves to fire the cartridge means that if the pistol is jarred, as for example by being dropped, it is virtually impossible for the necessary forces to be exerted on the mechanism to fire the pistol.

The abutment can, according to this invention, be rotatable between the in-path and the out-of-path positions. More particularly when the firing element is a longitudinally displaceable bolt and the abutment has a sleeve carried thereon, the firing means includes a torsion spring urging the abutment into the in-path position. The abutment is an arm projecting from the sleeve and the breech block is formed with a guide holding the abutment in operative engagement with the firing element on displacement of the trigger from the unactuated to the actuated position. In addition, in such an arrangement, the link means includes a trigger slide displaceable parallel to and transversely of the path of travel of the firing pin and having a spring urging it into engagement with the abutment.

The abutment can be a lever having one pivoted end and an opposite end engageable in the path of the firing element and deflectable thereby out of the path thereof to free the firing element for firing. More particularly, when the abutment is such a lever it can have one end engaging in the path of the firing element and another end formed with a slot. The frame has a pivot pin traversing the slot and the firing mechanism comprises a spring urging the one end away from the pivot pin. Once again, the displacement direction for the link is transverse, of the firing pin. Therefore, the pistol is very jar-resistant.

In accordance with this invention, the firing element can also be a hammer pivotal on the frame, in which case the firing mechanism includes a firing pin carrying the firing pin tip and engageable with the hammer and the spring means and abutment are engageable with the hammer. The abutment can be a two-arm lever blockingly engageable with the hammer and laterally deflectable out of engagement therewith. It can also be a longitudinally slidable trigger slide to this invention in the triggerless pistol according to this invention.

In a particularly simple construction according to this invention, the firing element is a firing bolt carrying the firing pin tip and a firing-bolt nose and the abutment is directly engageable with the nose. Furthermore, the link means includes a trigger slide and an inclined surface on the frame engageable with the trigger slide in the actuated position of the trigger. This link means includes a spring urging the slide into engagement with the inclined surface.

To eliminate the problem of firing-pin tip, breakage which plagues automatic pistols, the firing pin tip is lance-shaped and the breech block is formed with an elongated throughgoing slot through which the lance-shaped pin tip engages. More particularly, the firing pin has a flattened triangular tip lying in the pistol plane, so it is very strong in this direction, which is the same as the shell-ejection direction.

The pistol according to this invention has latch means for releasably securing the barrel to the frame. This means includes a projection on the barrel movable along a path on sliding of the barrel and breech block on the frame, a frame abutment on the frame and normally in the path, and means for moving the frame abutment out of engagement with the barrel projection. The frame abutment can be an eccentric pivotal into and out of the in-path position, or can be a slide displaceable parallel to the clip hole in the frame. Either arrangement makes removal of the slide relatively easy.

In addition, the pistol of this invention has a clip removably engageable with the frame and holding a supply of cartridges displaceable by the breech into the chamber, and safety means engageable between the clip and the link means for permitting the abutment to move out of engagement with the firing element only when at least one cartridge remains in the clip. To this end, the clip has a cartridge follower and the safety means includes an element on the frame engageable through the clip with the follower. Thus, when the last shot is fired, the slide will not return forward, so that a new clip can be inserted with automatic chambering of the first cartridge.

The pistol according to this invention is set up so that the abutment cannot catch the firing element and recock and fire it when the trigger is held back. Instead the trigger must be released between shots to move the link forward into its forward position where it can engage the abutment. In other words, the abutment and link can only engage one another when the firing element is in the intermediate position and the link is in the trigger-unactuated position.

With the pistol of this invention, releasing and firing are done with the same element. Thus, the condition of the pistol is the same before the first shot as it is before the subsequent shots. This is attained when the guide which establishes the path of the abutment during the loading motion blocks projection of the abutment into the travel path of the firing pin or hammer. The pistol is therefore always uncocked or partially uncocked.

Handling of the pistol according to the instant invention is therefore as simple as possible. The pistol is ready after chambering of the cartridge in the barrel for shooting at any time and is nonetheless completely safe from unintentional shots. Similarly in this condition the pistol is fully drop- and jar-resistant. As a result of the unchanging trigger force, accuracy is increased. Simple and safe handling of the pistol is ensured even for the unpracticed user.

As a result of the small number of parts and the possible fitting of the firing mechanism into a small space, the frame can be of one piece, preferably of a synthetic resin, so that the overall weight is substantially less than that of comparable known pistols. In addition, manufacture is simplified and made inexpensive. In fact, the entire frame can be a synthetic-resin casting made with a simple two-piece mold, and the various elements like the firing element and guide for the slide can be formed by metallic inserts.

DESCRIPTION OF THE DRAWING

The above and other features and advantages will become more readily apparent from the following, reference being made to the accompanying drawing in which:

FIG. 1 is a side view of a pistol according to the present invention;

FIG. 2 is a front end view of the pistol of FIG. 1;

FIG. 3 is a large-scale longitudinal section through a detail of the pistol of FIG. 1;

FIG. 4 is a top view of a detail of FIG. 1;

SPECIFIC DESCRIPTION

Figure 5:
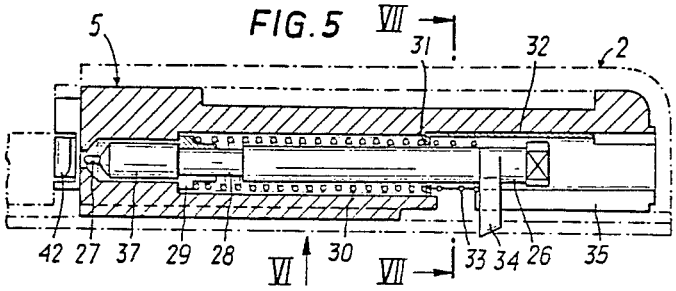
FIG. 5 is a longitudinal section through the breech of the pistol of FIG. 1.

As seen in FIGS. 1–12, the pistol in general is comprised of a frame 1 and a slide 2 which is displaceable on the frame 1 by means of a tongue-and-groove guide 3. The barrel 4 and breech block 5 are mounted on the slide 2. The barrel 4 has a chamber 6 and a downwardly projecting extension 7 in which a recess 8 is formed from which a forwardly upwardly inclined groove 9 extends. The barrel 4 has an upwardly directed projection 10 extending into a window 11 of the slide 2 so that the barrel 4 and breech block 5 are locked together for joint movement along the axis A of the barrel 4. The barrel 4 projects with play through an opening 12 at the front end of the slide 2 so that it is only held in the region of its chamber 6.

The slide 2 has an end wall 13 which serves as rest for a recoil spring 14. The other rest is formed by the rim 15 of a sleeve 16 that is surrounded with play by the recoil spring 14. The front end 17 of the sleeve 16 is received with play in a bore 18 of the end wall 13. The sleeve 16 is fixed axially by a bracket 19 which has a flange fitted in a slot of the frame 1.

Also mounted in the frame 1 is an eccentric 20 formed of a pair of disks 21 and 21' rotatable in a bore of the frame 1 and connected together by a stem 22. The disk 21' projects out of the frame 1 and carries a spring level 23 whose free end 24 can snap over a pin 25. When thus engaged over the pin 25, rotation of the eccentric 20 is impeded.

Figure 7:
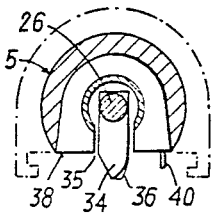
FIG. 7 is a section taken along line VII—VII of FIG. 5.
Figure 6:
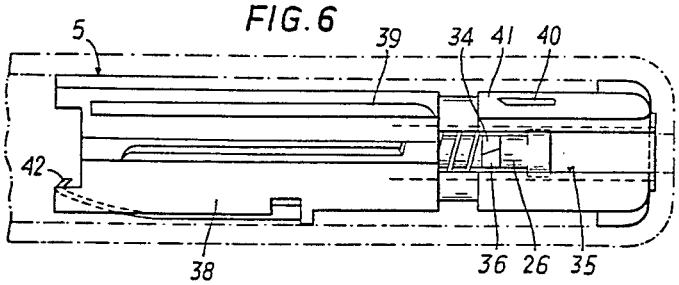
FIG. 6 is a top view of the breech of FIG. 5.

The breech block 5 is mounted axially unmovably in the slide 2. It only has centering surfaces which correspond to complementary surfaces of the barrel 4. As seen in FIGS. 5–7, a firing pin 26 generally centered on the barrel axis A is slidable in the breech block 5 and carries at its front end a firing pin tip 27. This firing bolt 26 has a section 28 of small diameter straddled by a spring rest 29 against which the firing pin spring 30 is braced and which bears with its other end against a shoulder 31 of a spring tube 32 which is downwardly open and which flatly abuts the breech block 5 with its rear end. A weak return spring 33 mounted in the tube 32 bears in one direction against the shoulder 31 of the spring tube and in the other direction on a nose 34 of the firing pin 26, which nose 34 projects with its tip down out of and is guided in a slot 35 of the breech block 5. The nose 34 is formed with an inclined surface 36. The position of the firing pin 26 is determined by engagement of its section 37 on the spring rest 29.

Ridges 39 and 40 are provided spaced one behind the other on the underside 38 of the breech block 5 so that a gap 41 is formed. The outer flank of the ridge 39 and the inner flank of the ridge 40 lie substantially in a plane. In addition, the breech block 5 has an extractor hook 42.

Figure 10:
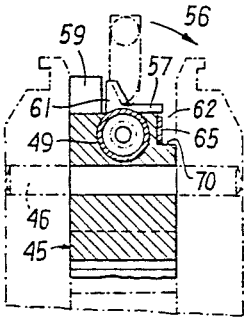
FIG. 10 is a section taken along line X—X of FIG. 9.
Figure 9:
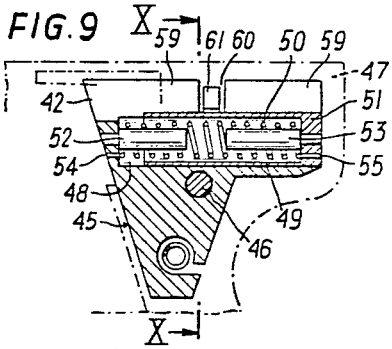
FIG. 9 is a longitudinal section through the mechanism of FIG. 8.

Behind a magazine hole 43 for the cartridge clip 44 (see FIG. 1), the frame 1 has a guide 45 fixed in place by a pin 46 as seen in FIGS. 8–12. The guide 45 extends to the rear end wall 47 of the frame 1 and is formed with a bore 48 whose axis is parallel to the bolt/barrel axis A. This bore 48 receives a stop sleeve 49 which contains a stop spring 50 which is braced between the floor of the bore 48 and the end wall 51 of the stop sleeve 49. This stop spring 50 is considerably weaker than the firing spring 30 that is oppositely braced against it as will become apparent hereinbelow. A pin 52 in the floor of the bore 48 and a pin 53 in the end wall 51 of the stop sleeve 49 guide it. The spring 50 is received with radial play in the sleeve 49. The wire ends 54 and 55 of the spring 50 are bent axially and are received in little bores respectively in the floor of the bore 48 and in the end wall 51. The stop spring 50 is not only axially, but also angularly loaded since the stop sleeve 49 is turned a few times when it is mounted to torsionally or angularly load the spring 50. In this manner, the sleeve 49 is urged clockwise according to arrow 56 (FIG. 10). To prevent such rotation it has an arm 57 which bears against the upper edge surface 58 of the guide 45. The guide 45 further has a shoulder 59 which is interrupted by a slot 60. The width of the slot 60 is such that an abutment 61 on the sleeve 49 can engage in it.

Figure 12:
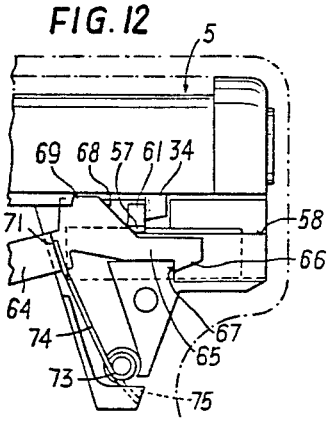
FIG. 12 is a side view of the firing mechanism in the ready-to-fire position.
Figure 11:
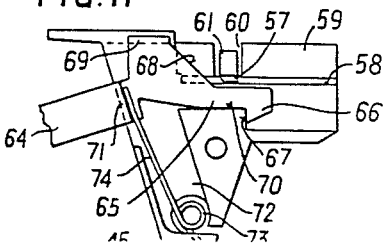
FIG. 11 is a side view of the firing mechanism in the uncocked position.
Figure 13:
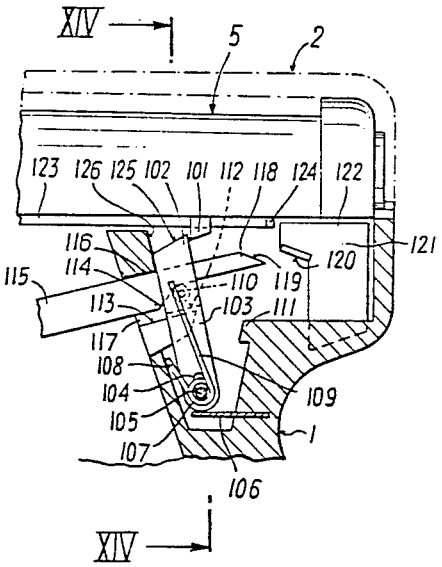
FIG. 13 is a longitudinal section like FIG. 9 through a second embodiment of the firing mechanism, in the uncocked position.

The guide 45 is provided with a longitudinally open recess 62 in which is slidable a trigger slide 64 connected to the trigger 63. This trigger slide 64 occupies only a portion of the recess 62 and has an arm 65 engaging underneath the arm 57 as shown in FIG. 12. The arm 65 terminates in a hook 66 which coacts with a step 67 on the guide 45. Furthermore, the slide 64 has a cam surface 68 which ends at a guide edge 69. The slide 64 is thus on one side guided by the floor 70 of the recess 62 and on the other side with the edge 69 on the underside 38 of the breech block 5 so that it can move substantially only parallel to the axis A of the firing pin 26. It is provided with a bend 71 on which bears the long leg 74 of a hairpin spring 73 received in an elongated cutout 72 of the guide 45 and having a short leg engaged in a slot 75 of the frame 1. The spring is constructed such that the long leg 74 urges the trigger slide 64 forward and the arm 65 toward the spring sleeve 49.

Figure 21:
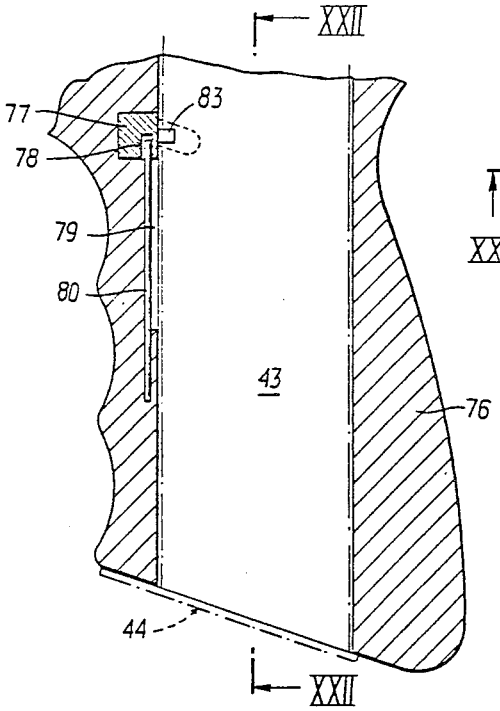
FIG. 21 is a large-scale longitudinal section through a detail of FIG. 1.
Figure 22:
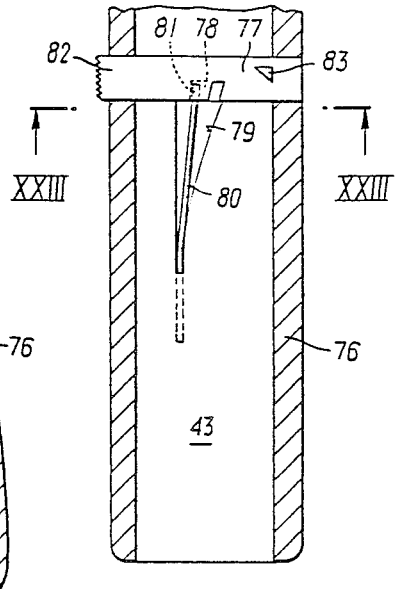
FIG. 22 is a section taken along line XXII—XXII of FIG. 21.
Figure 23:
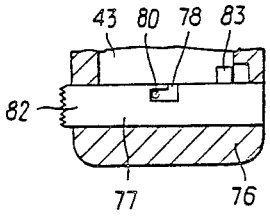
FIG. 23 is a section taken along line XXIII—XXIII of FIG. 22.

As seen in FIGS. 21–23, inside the grip 76 of the frame 1 is formed with a square-section passage transverse to the hole 43 for the cartridge clip 44 and receiving a slide 77 having a downwardly open bayonet guide 78. Near this slide 77 the hole 43 is formed with a wedge-shaped recess 79 into which a bore opens that receives a spring wire 80 that engages with its free end 81 in the bayonet guide 78. In addition, the slide 77 projects with its end 82 out of the grip 76 so that it can be shifted against the force of the spring 80. It carries a wedge nose 83 which engages in a groove of the clip 44.

FIGS. 5 to 11 show the pistol uncocked. In order to chamber the first cartridge 84 in the barrel 4, the slide 2 is slide back against the force of the recoil spring 14. The stem 22 of the eccentric 20 engages in the groove 9, swings the barrel 4 down, and holds it against axial movement relative to the slide 2 once it reaches the base of the groove 9. This action pulls the projection 10 of the barrel 4 out of the window 11 so that the slide 2 with the breech block 5 can move further back. Meanwhile the nose 34 of the firing bolt 26 carries back the abutment 61 as can be understood from a comparison of FIGS. 7 and 10. The nose 34 is prevented from rotating by the groove 35, as is the abutment 61 which lies on the front part of the shoulder 59. Once the abutment 61 and the stop sleeve 49 have moved back sufficiently, while unloading the stop spring 50, the abutment 61 can move angularly into the slop 60. Thus, the cam surface 36 of the nose 34 pushes the abutment 61 against the torsional force of the stop spring 50 into the slot 60 so that this nose 34 can move back past the abutment 61. As soon as the nose 34 passes the abutment 61, it is turned by the spring 50 back into the position of FIG. 10. The sleeve 49 engages with its end wall 51 against the rear end wall 47 of the frame 1 and is solidly positioned here by the axially effective force of the stop spring 50.

When the slide 2 is returned somewhat forward, the nose 34 of the firing pin 26 engages forward against the abutment 61. The force of the firing pin spring 30 overcomes that of the stop spring 50 so that the nose 34 slides the abutment 61 and the sleeve 49 forward until the end of same engages the floor of the bore 48 in the guide 45. Further advance of the slide 2 is impeded as the abutment 61 holds the nose 34 and the firing pin 26, thereby partially tensioning the firing pin spring 30. Simultaneously, the breech block 6 is closed by the breech block 5 and moved forward with the barrel 4. This lifts the rear portion of the barrel 4 from the stem 22 so the projection 10 engages again in the window 11 of the slide 2 and the barrel 4 and breech block 5 are locked together. During this action, as is known, the extractor finger 42 engages the lip of the casing of a shell in the chamber 6, pulls it axially backward therefrom, and flips this spent casing out the window 20 as same comes level with the extracted casing.

Pulling the trigger 63 moves the trigger slide 64 back so the cam surface 68 engages under the arm 57 and urges it up. Since the abutment 61 lies on the front shoulder 59, further movement of the trigger 63 moves the arm 57, the sleeve 49, the abutment 61 and the firing pin nose 34 entrained thereby back while unloading the stop spring 50 and loading the firing pin spring 30. Thus, it is only necessary to bring a force to bear on the trigger 63 equal to the difference between the forces of the springs 30 and 50 to move these elements of the mechanism. By choosing appropriate spring forces, the pressure for the trigger 63 can be set at any desired level.

As soon as the abutment 61 reaches the slot 60, the cam surface 68 of the trigger slide 64 raises the arm 57 and swings the abutment 61 into this slot 60. This frees the nose 34 and the firing pin 26 is propelled forward by the force of the spring 30, overcoming the spring force of the weak return spring 33. The firing pin tip 27 strikes as a result of the kinetic energy of the firing tip 26 with the necessary force on the primer of the cartridge, exploding it. As soon as the shot has left the barrel 4, the power gases drive the slide 2 in the above-described manner back, with the rail 39 on the underside 38 of the breech block 5 engaging the guide edge 69 of the trigger slide 64 and moving it outward against the force of the hairpin spring 73.

Meanwhile the arm 57 disengages the cam surface 68 and returns with the abutment 61, which moves out of the slot 60 under the force of its stop spring 50, into the starting position in which the arm 57 lies on the surface 58 of the guide 45. If the slide 2 is moved by the recoil spring 14 forward again, the nose 34 entrains the abutment 61 until the sleeve 49 engages with its end surface on the base of the bore 48. Further advance of the slide partially compresses the firing-pin spring 30 again. Since the trigger slide 64 does not yet engage the arm 57, it is prevented from shooting automatically when the trigger 63 remains depressed. Only when the trigger 63 is released does the guide edge 69 slide along the rail 40 forward to be pressed by the spring 73 into the gap 41 between the ridges 39 and 40 so the arm 65 of the trigger slide 64 engages under the arm 57. Simultaneously, the return spring 33 slides the firing pin 26 until it lies with its front section 37 on the spring rest 29, whereupon the firing pin tip 27 is withdrawn into the breech block 5. Now the pistol is again ready to fire.

If the spring arm 23 is pulled out of the catch 25 it can rotate the eccentric 20 through 180°. The stem 22 disengages the barrel 4 and the entire slide 2 can be pulled off toward the front. The recoil spring 14 meanwhile remains compressed since the shoulder 15 of the sleeve 16 bears on the projection 7 of the barrel 4. The slide 2 can therefore be shifted without exerting substantial force.

FIGS. 13 to 16 show a further embodiment of the firing mechanism according to this invention. Otherwise the pistol is identical to that shown in FIGS. 1 to 12 with identical reference numerals referring to identical structure.

Figure 15:
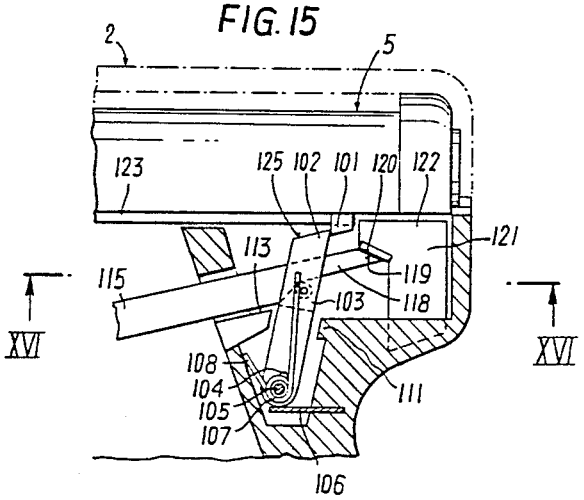
FIG. 15 is a section like FIG. 13 but in the cocked position.

A nose 101 formed unitarily with the firing pin 26 projects down and toward the front from the breech 5. This firing pin 26 is mounted in the breech block 5 which is fitted jointly with the barrel 4 in the slide 2. Engaged in the path of the nose 101 is the abutment end 102 of a lever 103 which is formed on its other end with a slot 104 that is traversed by a pivot pin 105, the lever 103 therefore being limitedly displaceable transverse to the breech block 5 in the frame 1. A spring 106 fixed in the frame 1 presses with its free end against the pivoted end of the layer 103 so that the outer end of the slot 104 bears on the pivot pin 105, that is so that the lever 103 is moved up on the pin 105 toward the slide 2. A hairpin spring 107 carried on the pin 105 has a short leg 108 anchored in the frame 1 and a long leg 109 bearing on a pin 110 which is fixed on the lever 103. This spring 107 therefore urges the lever clockwise toward a position lying on a stop 111 in the frame 1 (FIG. 15).

The lever 103 has a shoulder 112 which coacts with a shoulder 113 of the frame 1. The shoulder 113 is so long that it only moves clear of the shoulder 112 when the lever 103 is in its rear end position (FIG. 15) lying against the stop 111. Before reaching this end position, the shoulders 112 and 113 prevent a shifting of the lever 103 against the force of the spring 106 and a simultaneous sliding of the slot 104 along the pin 105.

Figure 16:
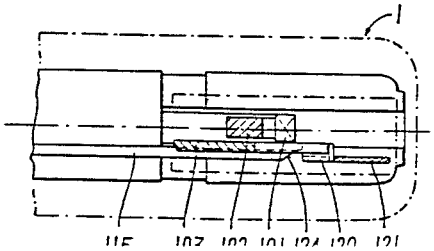
FIG. 16 is a section taken along line XVI—XVI of FIG. 15.

The pin 110 of the lever 103 is engaged by an edge 114 of the trigger slide 115 which passes through a hole 117 in the frame 1. It extends with its arm 118 beyond the pin 110 and its end surface 119 coacts with another surface 120 formed by a bent-over end of a leaf spring 121 that is fixed in the frame 1. Above the surface 120, the leaf spring 121 is provided with a control edge 122 which coacts with a ridge 123 on the underside of the breech block 5. The end surface 124 of the ridge 123 is inclined as seen in FIG. 16.

In the uncocked position of the pistol the lever 103 is urged by the spring 107 against the stop 111. If the slide 2 is shifted back in order to chamber the first cartridge from the clip, the nose 101 slides over the end surface 125 of the lever 103 and moves it down against the force of the spring 106. As a result, the lever 103 can be passed by the nose 101. Forward shifting of the slide 2 causes this firing pin nose 101 to again entrain the lever 103 whose end 102 extends into its path until the lever 103 engages against a stop 126, assuming the position of FIG. 13. In this position, the nose 101 and the firing pin 26 are prevented from moving forward any further. Further forward sliding of the slide 2 compresses the firing pin spring 30 partially. The pistol is ready to shoot in this condition.

When the trigger slide 115 is pushed back by the trigger, it slides on the surface 116 of the frame 1 and its edge 114 pushes the pin 110, the lever 103, and the nose 101 back also. This fully loads the firing-pin spring 30. When the lever 103 reaches its rear end position and engages the abutment 111, the end surface 119 of the trigger slide 115 engages the surface 120 and moves the trigger slide 115 down against the force of the spring 106 so that it moves away from the surface 116, and the pin 110 as well as the lever 103 move down. This moves the free lever end 102 out of the path of the nose 101, freeing it, so that the firing pin 26 is propelled forward under the force of the fully compressed firing-pin spring 30 and fires the cartridge.

Figure 14:
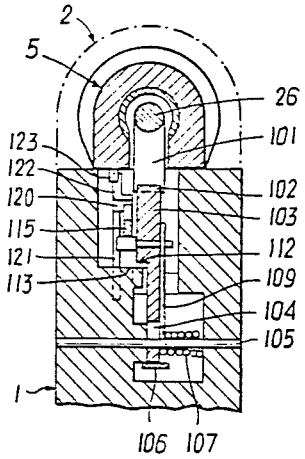
FIG. 14 is a section taken along line XIV—XIV of FIG. 13.

When the slide 2 is then driven back by gases from the shot, the inclined surface 124 of the ridge 123 on the breech block 5 pushes the leaf spring out (FIG. 14). The control edge 122 of the spring 121 thus lies against the ridge 123 until the slide 2 returns to its full-forward position. Deflection of the spring 121 makes the surface 120 slide off the end surface 119 of the trigger slide 115 and the spring 106 lifts the lever 103 and with it the arm 118 of the trigger slide 115. The ridge 123 frees the control edge 122 when the breech block 5 moves into the full-forward position, but the spring 121 cannot return to its original position because the arm 118 lies at the same level as the bend where the surface 120 is. Only when the trigger is released and the trigger slide 115 slides forward is the leaf spring 121 released and takes its illustrated rest position. The trigger slide 115 need not be in its full-forward position shown in FIG. 13 for the pistol to be ready to fire; the surface 119 and 120 need merely be separated. This embodiment of the firing mechanism allows rapid fire in that a shot following another shot can be made without complete release and depression of the trigger. Nonetheless, some forward return of the trigger is essential for a second shot so the pistol does not fire automatically.

In this arrangement also the mechanism can be mounted in a block, such as the guide 45, in the frame 1.

Instead of a sliding of the lever 103 in its longitudinal direction, the lever can also be moved laterally out of the path of the firing-pin nose 101. Such an arrangement is not illustrated, because it is basically a combination of the two described embodiments.

FIGS. 17 to 20 show a part of a pistol that is provided with a hammer 131 that on shooting is pivoted by the force of a spring 135 on a pivot pin 132 and engages a firing pin 26 which fires the cartridge. Even in this type of pistol it is possible to use the principles of the instant invention.

The hammer 131 is pivotal in the frame 1 about a pivot pin 132 and the rod 133 is pivoted on the hammer 131. This rod 133 is arranged in a cutout 134 of the frame 1 and is braced against the hammer compression spring 135. The hammer 131 has a lateral shoulder 136 on which a two-arm lever 137 engages with its one arm 138. Its other arm 139 is braced against an abutment spring 140 which is received in a bore of the frame 1. The two-arm lever 137 has in its center between its two arms a slot 141 that is traversed by a pivot pin 142 and about which the lever 137 is pivotal. Furthermore, the lever 137 is provided with a lateral projection 143 which forms a shoulder 144 that faces a shoulder 146 of the frame 1. The trigger slide 146 engages with a shoulder 147 on the projection 143 and extends through an opening 148 in the frame 1. Its free end is provided with an inclined surface 149 that coacts with a surface 150 formed by the bend of a leaf spring 151 whose end surface 152 acts as a control edge that coacts with a ridge 153 of the breech 5. The leaf spring 151 is anchored with its lower end in the frame 1. In addition a stop 154 is formed in the frame 1 to limit the forward pivot motion of the lever 137.

Figure 17:
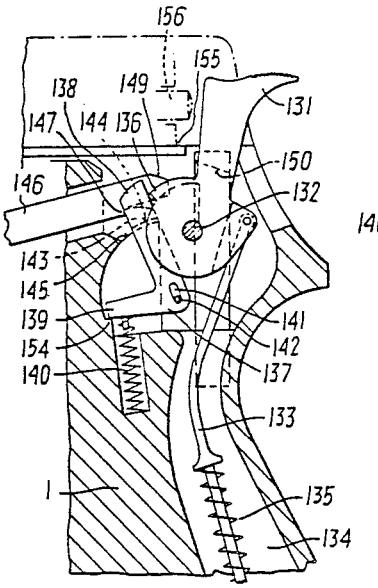
FIG. 17 is a longitudinal section like FIG. 9 through a third embodiment of the firing mechanism, in the uncocked position.
Figure 18:
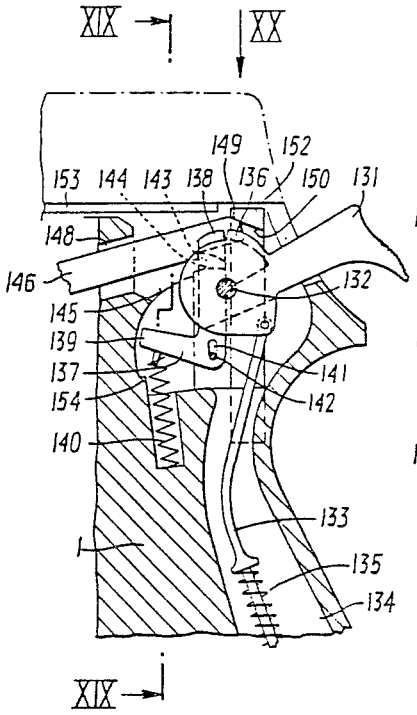
FIG. 18 is a section like FIG. 17 but in the cocked position.

FIG. 17 shows the firing mechanism in the uncocked condition. To cock it the trigger slide 146 is moved back by means of the trigger so that it pivots the projection 143 of the lever 137 back by means of the shoulder 147. The free end of the lever 137 serving as stop lies meanwhile on the step 136 of the hammer 131 and pivots it clockwise against force of the hammer spring 135. As soon as the inclined surface 149 of the trigger slide 146 reaches the surface 150 (FIG. 18) the trigger slide 146 swings down, whereupon the lever 137 is shifted down against the force of the abutment spring 140 in the slot 141 and its abutment end frees the shoulder 136 of the hammer. The hammer is snapped forward by the hammer spring 134 to strike the protruding rear end 156 of the firing pin 26, which in turn is propelled forward to fire the cartridge.

Figure 19:
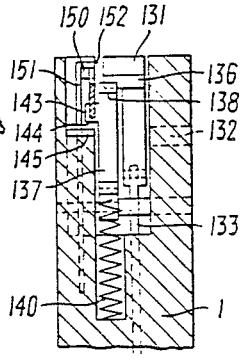
FIG. 19 is a section taken along line XIX—XIX of FIG. 18.
Figure 20:
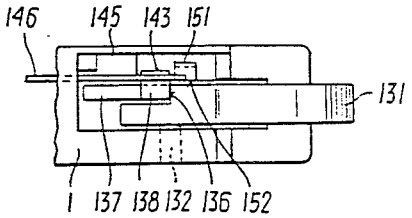
FIG. 20 is a top view taken in the direction of arrow XX of FIG. 18.

After the shot the gases drive the slide 2 with the breech block 5 back so that the inclined end face of the ridge 153 runs against the control surface 152 of the leaf spring 151 to pivot same outward (FIG. 19). As a result the surfaces 149 and 150 disengage each other and the stop spring 140 slides the lever 137 together with the trigger slide 146 up so that the end of same comes to lie next to the bend of the spring 151. Simultaneously as the slide reverses direction and follows the breech block 5 a rear edge 155 of the breech block 5 engages the hammer 131 and pivots it back counterclockwise against the force of its spring 135. The hammer 131 entrains with its shoulder 136 the abutment end 138 of the lever 137 until this lies on the stop 154. In this position the hammer 131 is a sufficiently safe distance behind the rear end 156 of the firing pin 26. As soon as the trigger is released, the trigger slide 146 moves forward so that the firing mechanism again assumes the position of FIG. 17. Thus the pistol cannot make automatic fire, that is a separate actuation of the trigger is need for each shot.

Figure 24:
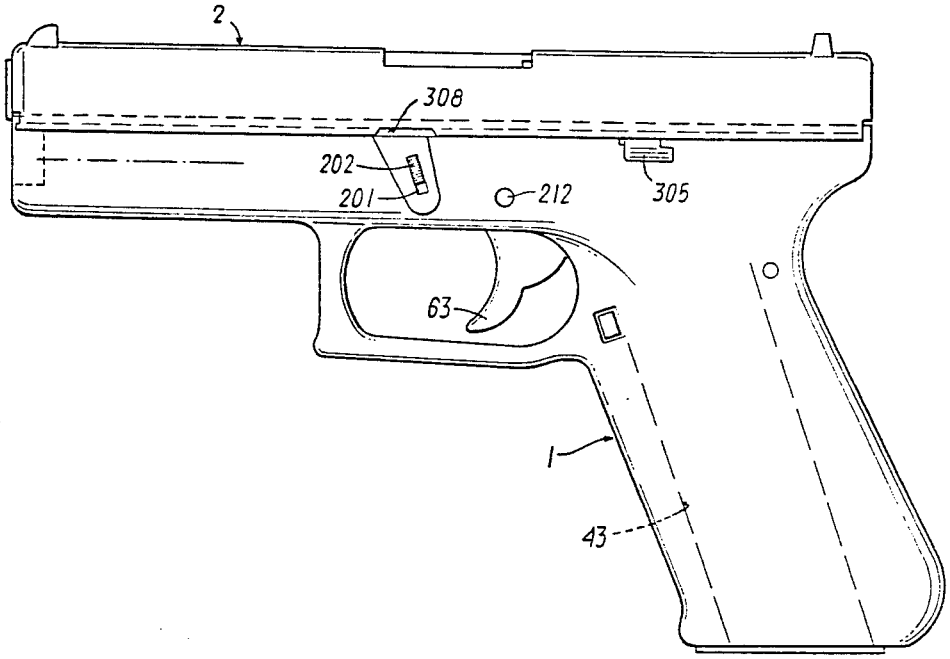
FIG. 24 is a side view of another pistol according to the present invention.
Figure 25:
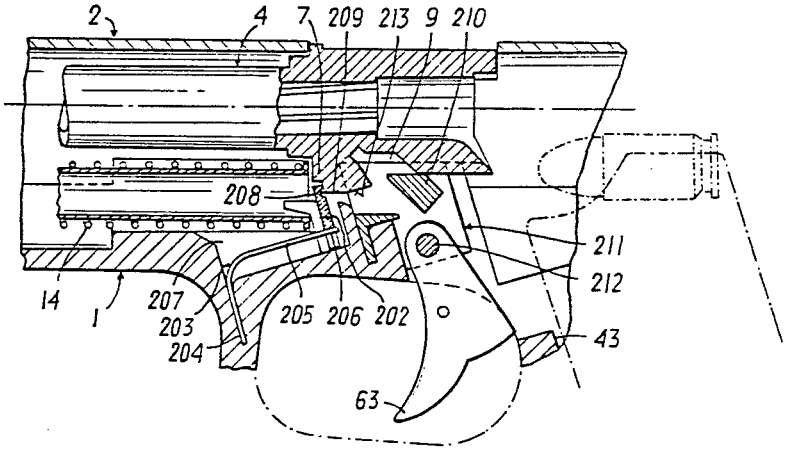
FIG. 25 is a large-scale longitudinal section through a detail of the pistol of FIG. 24.
Figure 26:
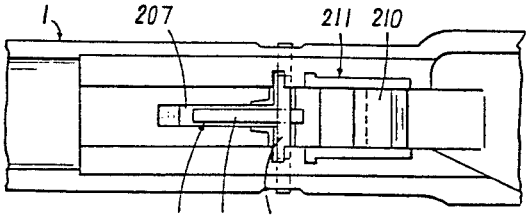
FIG. 26 is a top view of the detail of FIG. 25.

FIG. 24 shows a pistol in side view in which disassembly is effected by a slide catch 202 which takes the place of the eccentric 20 of FIG. 1. The frame 1 has a slot 201 in which the catch 202 is shiftable and urged upward by a leaf spring 203 having has a short arm 204 fitted into the frame 1 and a long arm 205 engaged in a groove 206 of the catch 202. Since this spring arm 205 is arranged in a slot in the frame 1, the catch 202 is also prevented from moving longitudinally of itself, that is transversely of the central plane of the pistol.

The catch 202 is formed in its central region near the upper edge with a groove 208 in which a ridge 209 of the projection 7 of the barrel 4 can engage. This projection 7 in turn has an inclined groove 9 which coacts with a strut 210 of an anchor piece 211 fitted into the frame 1 and secured therein by a pin 212 which also serves as pivot for the trigger 63.

The groove 207, the groove receiving the spring arm 204, the slot 201, and the recess for holding the support piece 211 are inclined to the barrel axis A and preferably are parallel to the hole 43 for the cartridge clip 44 so that shaping of the core for the manufacture of these grooves and recesses can be quite easy. It is therefore possible to make the frame 1 in one piece of a synthetic resin in a mold whose halves are separated in a direction parallel to the oblique hole 43 and the parallel grooves mentioned above.

The function of the strut 210 corresponds to that of the stem 22 of the eccentric 20 of FIGS. 1 to 4. In order to pull the slide 2 with the barrel 4 and recoil spring 14 off the front of the frame 1, the slide 2 must be pulled back a little so that the ridge 209 of the projection 7 moves out of the groove 208 of the catch 202. Then the slide 2 is moved down against the force of the spring 203 so as to free the barrel 4 and slide 2 from the catch 202 for unimpeded forward movement on the frame 1. On replacing the slide 2 on the frame 1 a wedge surface 213 runs over the upper edge of the catch 202 and pushes it down against the force of the spring 203. Once the projection 7 has passed the catch 202, the ridge 209 is moved by the spring 203 up and latches in the groove 208 of the catch 202 whereupon mutual tongue-and-groove locking is ensured.

This type of barrel locking can also be used in other types of pistols.

Figure 27:
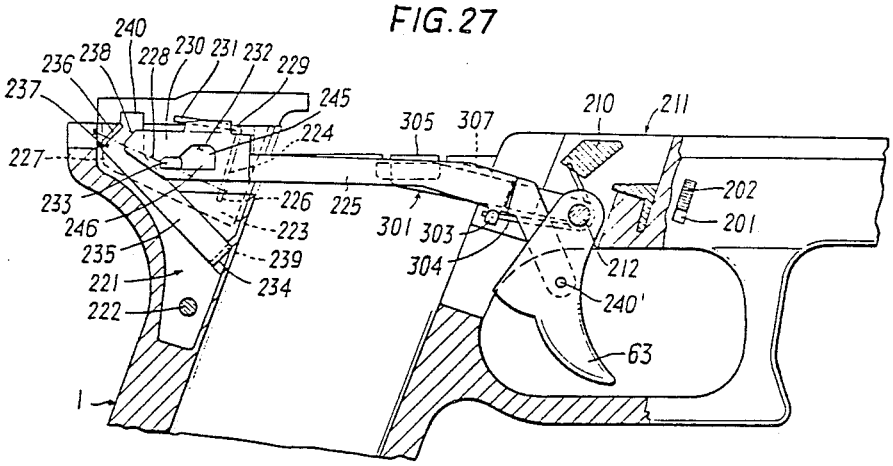
FIG. 27 is a large-scale longitudinal section through the firing mechanism of the pistol of FIG. 24.
Figure 28:
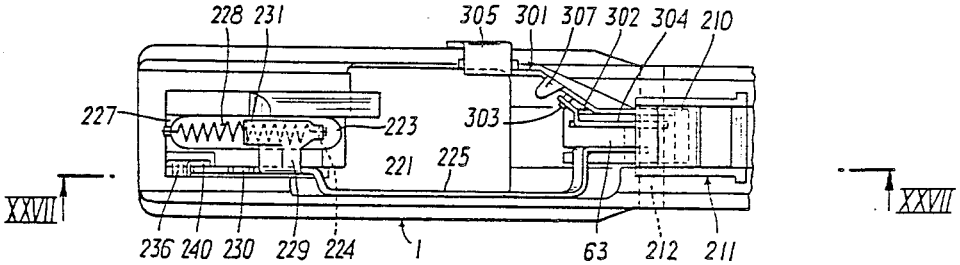
FIG. 28 is a top view of the detail of FIG. 27, line XXVII—XXVII being the section plane for FIG. 27.
Figure 29:
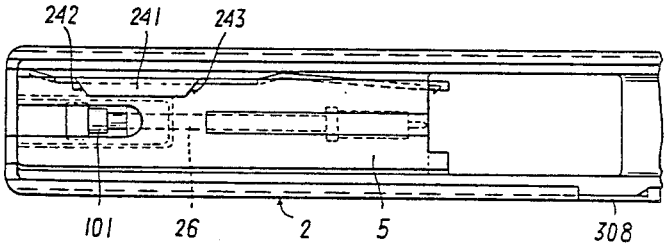
FIG. 29 is a bottom view of the slide of the pistol of FIG. 24.

FIGS. 27 to 29 show another trigger mechanism which is very simple. A block 221 is fitted in the frame 1 and is held in place therein by a pin 222. It has in the region of the longitudinal central plane of the pistol a cavity 223 in which a bent arm 224 of the trigger slide 225 engages. Stretched between a lower end 226 of the trigger slide 225 and the rear wall 227 of the cavity 223 is a tension spring 228 which pulls the trigger slide 225 up and back.

The arm 224 of the trigger slide 225 is connected by a web 229 with a plate-like end 230 of the trigger slide 225. This web 229 has a backward projecting part 231 that forms an abutment for the firing pin 26. The plate 230 is formed with a polygonal recess 232 which is traversed by a projection 233 of the block 221. Near this projection 233 the block 221 has a groove 234 which extends upward and back and in which a leaf spring 235 is fitted which has an outwardly directed edge 236 which forms a control surface 237 for an inclined end surface 238 of the trigger slide 225. The other end of the leaf spring 235 is bent in the opposite direction from the edge 236 and is fitted in a groove 239 of the block 221. Near the edge 236 is a control edge 240 which is arranged in the path of a control ridge 241 on the underside of the slide 2 and formed on its ends with two cam or wedge surfaces 242 and 243. The front end of the trigger slide 235', is pivoted on a pin 240' on the trigger 63.

In the uncocked condition of the pistol, the spring 228 urges the trigger slide 225 into its back position with the inclined surface 238 lying on the control surface 237 so that the projection 233 is in the upper part 245 of the recess 232. In this position of the slide 225, the abutment 231 lies underneath the path of the nose 101 of the pin 26.

To chamber the first cartridge, the slide 2 is pulled back so that the control edge 240 is moved inward by the wedge surface 242 of the guide 241 on the slide 2 and the inclined surface 238 of the trigger slide 225 and the control surface 237 of the leaf spring 235 disengage each other. As a result the spring 228 can pivot the trigger slide 225 up so that the projection 233 comes to lie in the lower region 246 of the recess 232 of the plate 230. Meanwhile the end of the trigger slide 225 has laterally run past the edge 236 so that the surfaces 237 and 238 are out of alignment with each other and therefore without mutual effect. In this position the abutment 231 moves into the path of the nose 101 of the firing pin 26 so that, as the slide 2 is moved forward, the nose 101 engages the abutment 231 and moves the trigger slide 225 forward until the projection 233 assumes the position in the recess 232 shown in FIG. 27. The pistol is now cocked.

On pulling the trigger at first the slide 225 is guided by the projection 233 and the spring 228 against the force of the bolt spring 30, which is hereby loaded, and slides back until the surfaces 237 and 238 engage each other.

In this position, the projection 233 has reached the broad part of the recess 232 so that the trigger slide 225 can swing down as the inclined surface 238 slides on the control surface 237. The abutment 231 then frees the nose 101 of the firing pin 26 and the shot is fired.

On backward displacement of the slide as a result of the recoil, the wedge surface 242 moves the control edge 240 inward so that the above-described interaction can repeat itself. The position of the control ridge 241 ensures that the wedge surface 242 of the control edge 240 is only freed when the barrel 4 and breech block 5 are locked together. If for any reason the slide 2 has not moved fully forward, the ridge 241 holds the leaf spring 235 in its inwardly bent position in which pulling of the trigger 63 is ineffective because the inclined surface 238 cannot engage the control surface 237 so that the trigger slide 225 does not swing down and the abutment 231 cannot free the firing-bolt nose 101.

A device can also be provided to ensure quick preparation to fire on changing the cartridge clip, whose construction is described in detail below with reference to FIGS. 32–35. To this end, a lever shown generally at 301 is provided which is pivoted on the axle pin 212 of the trigger 63 and received in a laterally open recess 302 of the trigger 63. The lever 301 is provided on its underside with a hook 303 in which is hooked the end of a hairpin spring 304 which surrounds the pin 212 partially and is caught in a groove of the web 210. This spring 304 tries to pivot the lever 301 into a lower end position in which a handle 305 lies in a recess of the frame 1. In addition the lever 301 has on its upper side a nose 307 which engages in the path of a slide that is backed up by a spring in the clip, as will be described below and which urges the cartridges upward. When the last cartridge of the clip is inserted into the barrel 4, the slide of the clip engages the nose 307 of the lever and tries to pivot same up. Such pivoting of the lever 301 is prevented by the lower edge of the slide 2. After firing the cartridge, the lever 301 enters into a recess 308 (FIG. 29) on the lower edge of the slide 2 when this is in its end position. The lever 301 latches the slide 2 against moving forward. Swinging of the lever 301 on the pin 212 (FIG. 24) maintains this latching even when the clip is removed and replaced with a new clip. As soon as the handle 305 of the lever 301 is swung down, the slide 2 is moved by the force of the recoil spring 14 forward and pushes the first cartridge of the new clip into the barrel 4. Thus it is no longer necessary to pull back the slide after changing the cartridge clip.

Figure 30:
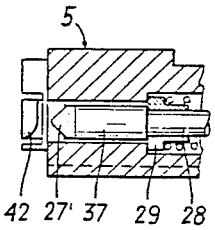
FIG. 30 (same sheet as FIGS. 5–12) is a longitudinal section through a firing-pin assembly according to this invention.
Figure 8:
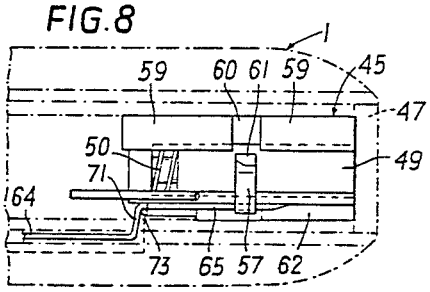
FIG. 8 is a top view of the rear portion of the firing mechanism.
Figure 31:
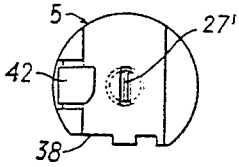
FIG. 31 (same sheet as FIGS. 5–12) is a front end view of the assembly of FIG. 30.

With the known pistols and center-fire cartridges it is possible to break off or damage the firing pin, on the firing pin when this pin does not pull back into the end of the breech block 5 quickly enough. As shown in FIGS. 30 and 31, according to the invention, the firing pin 27′ is pointed and lance-shaped, that is it is not of cylindrical shape as is standard, but is of rectangular section with a substantially greater vertical dimension in the pistol plane than transverse dimension. The pin tip 27′ can engage through an elongated cutout lying on the longitudinal middle plane of the pistol at the breech end. When a spent shell is ejected or a new cartridge is chambered, before the pin tip 27′ engages fully in the cutout in the end of the breech block 5, the firing pin is not damaged but is pushed back by the shell or cartridge. By means of the elongated shape of the cutout according to this invention pistols with drop barrels do not develop the otherwise normal brass-chip deposits.

Lance-shaped according to this invention means any shape which varies from the round section and cylindrical shape of the known firing pins and which has a generally flat shape. Preferred is a triangular shape which is obtained, for example, from a pyramid with spherically rounded points that is formed on opposite sides with symmetrical shoulders so that the remaining parabolic flanks can be made planar, slightly convex, or concave.

Figure 33:
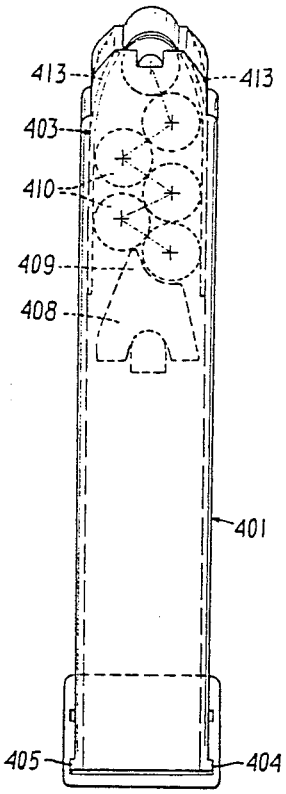
FIGS. 33, 34, and 35 are respectively back end, partial front, and top views of the clip of FIG. 32.
Figure 32:
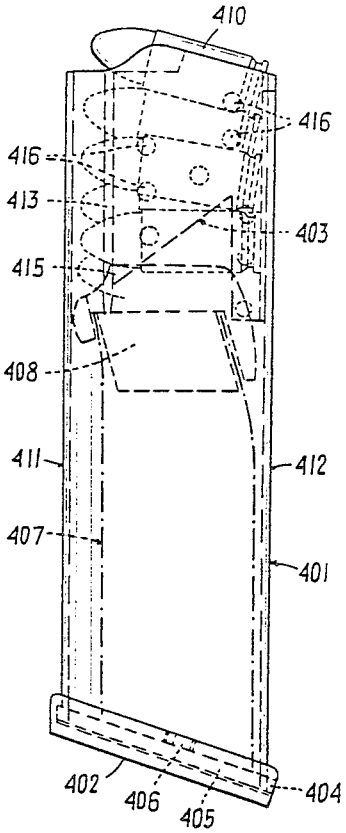
FIG. 32 is a side view of the clip for the pistol of FIG. 1.
Figure 34:
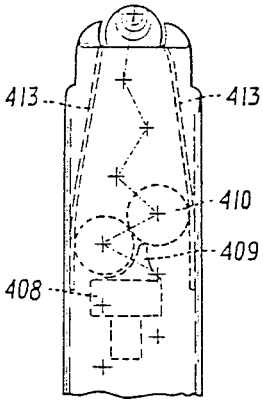
Figure 35:
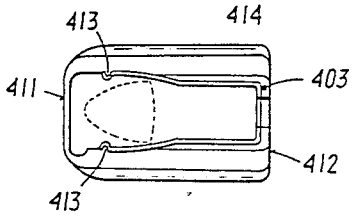
Figure 36:
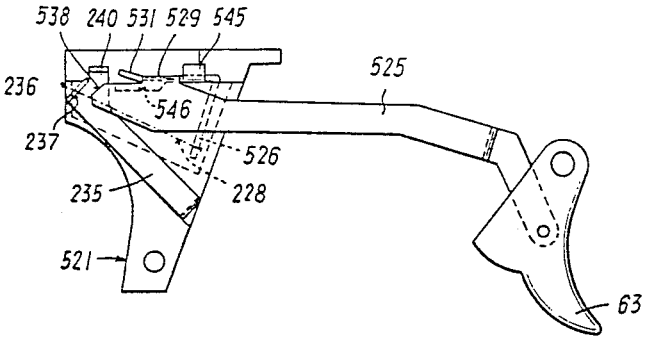
FIG. 36 is a side view of yet another firing mechanism according to the invention.
Figure 38:
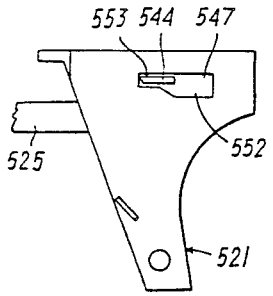
FIG. 38 is a view in the direction of arrow XXXVIII—XXXVIII of a detail of FIG. 37.
Figure 37:
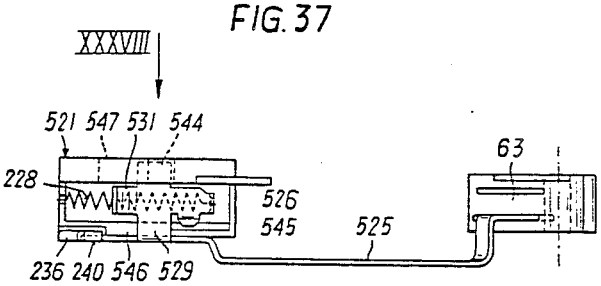
FIG. 37 is a top view of the structure of FIG. 36.
Figure 39:
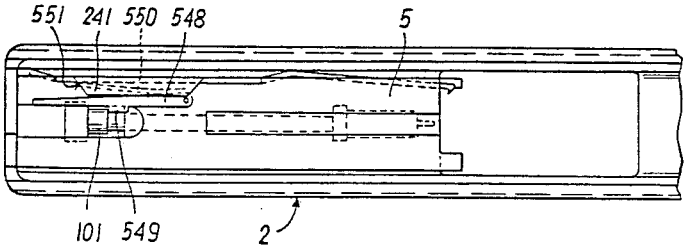
FIG. 39 is a bottom view of a slide that works with the mechanism of FIGS. 36–38.

The cartridge clip shown in FIGS. 32 to 35 has an elongated and generally parallepipedal synthetic-resin body 401, a base 402 inclined obliquely to the body 401, and a metal insert 403 inside the body 401. The metal insert 403 has holes 416 that flare inward so that the insert can be well anchored in the synthetic-resin body 401 of the clip. The base 402 has grooves 404 that fit on ridges 405 on the lower end of the clip body 401, with a latch 406 blocking unintentional sliding-off of the base 402. A spring 407 is braced at one end of the base 402 and at the other end on a follower slide 408 so as to urge same upward. Shoulders 409 at one end of the follower 408 support the cartridges 410 in the lower portion of the body 401 with their axes perpendicular to a front wall 411 and a rear wall 412 of the body 401. In the upper portion of the body 401 the insert 403 forms, in the region of the slugs, guides 413 that narrow considerably upward and that push the tips of the cartridges 410 together toward the central plane of the clip, which coincides with that of the pistol when the clip is in place in the well 43 thereof, so that the cartridge 410 align and finally assume a position generally parallel to the clip base 402. Portions 414 of the metal insert 403 at the back of the cartridges 410 converge first toward the end of the clip so that as shown in FIG. 33 the backs of the cartridges 410 remain longer in their original staggered positions. This can be seen by a comparison of the dot-dash zig-zag lines of FIGS. 33 and 34.

As a result of the construction according to the invention, two considerable advantages are obtained. The position of the cartridge backs ensures a solid contact between them and the back wall 412 of the clip so that friction is reduced as is the resistance to displacement. Catching on the back wall is impossible. The second advantage is that the contact between the cartridges 410 as they are aligned in the upper section of the clip changes. It moves from line contact to point contact so that in the upper part of the clip there is no welding-together of the cartridges 410.

The front end 415 of the shoulder 409 of the slide 408 can coact with the lever 301 of FIG. 28 so that this part comes to lie on the projection 307 when the last cartridge 410 is chambered.

FIGS. 36 to 39 show a variant of the firing mechanism of FIGS. 27 to 29, in which the guide is not in the trigger slide but in the frame 1 or in a block 521 set into the frame 1. The block 521 is of a synthetic resin and has a leaf spring 235 whose end 236 forms a control surface 237 which coacts with an inclined surface 538 of the trigger slide 525. Similarly the control edge 240 coacts with the ridge 241 of the slide 2. The trigger slide 525 has a web 529 which carries on one side the abutment 531 and on the other side the bent-over part 526. In addition it is provided with a wing-like projection 544 and has a control edge 545.

A recess 546 on one side and on the other side a recess 547 serve as a guide in the block 521 in which the wing 544 engages. The underside of the breech block 5 is provided with a simple pivotal lever 548 which has a projection 549 extending into the path of the firing-pin nose 101. This lever 548 is braced against a leaf spring 550 which is braced with its free end 551 on the breech block 5 and which lies underneath the ridge 241 so as to pivot the lever 548 such that the projection 549 is in the path of the firing-pin nose 101.

The operation of this firing mechanism corresponds mainly with that of the mechanism shown in FIGS. 27 to 29. The abutment spring 228 draws the trigger slide 525 back so that its inclined surface 538 slides down along the control surface 538 and the web 529 enters the recess 546 and the wing 544 enters the lower region 552 of the hole 547. In this position, the abutment 531 is below and out of the path of the firing pin nose 101. Meanwhile the control edge 545 is below the lever 548 so that it takes the position of FIG. 39 in which the firing pin is locked.

When the sliding 2 is moved back, the ridge 241 pushes the spring 235 toward the center so that the control surface 237 is guided by the inclined surface 538 and the trigger slide 525 is freed. The abutment spring 228 draws this slide 525 up and back while the abutment 531 and the control edge 545 are drawn into the path of the firing-pin nose 101.

When the slide 2 is moved forward, the firing-bolt nose 101 entrains the abutment 531 and the slide 525 as well as the trigger 63. Meanwhile the web 529 moves out of the recess 546 and the wing 544 engages in the narrow region 553 of the recess 547. As soon as the wing 544 gets to the end of the recess 547, the abutment 531 is held solidly by the firing-pin nose 101. The narrow section 553 of the hole 547 holds the abutment 531 tightly.

Pulling the trigger moves the slide 525 back and the abutment 531 pushes back the firing-pin nose 101 while further compressing the firing-pin spring 30. As soon as the inclined surface 538 engages the control surface 237, further movement of the slide 525 pushes it down so that the web 529 engages in the recess 546 and the wing 544 in the wide region of the recess 547. As a result the abutment 531 releases the firing-pin nose 101 and the shot is fired.

Moving the slide 525 moves the control edge 545 back into the region of the projection 549 and pushes the lever 548 to the side so that the projection 549 moves out of the path of the firing-pin nose 101 and does not impede forward travel of the firing pin.

Since the additional safety catch 548, 549 is on the breech block 5, jarring and inertial forces cannot open it. To fire it is therefore necessary to actuate the trigger 63.

The invention is not limited to the described and shown embodiments. Its parts can be combined in other than the shown manner. It is common to the described embodiments that the abutment for the firing pin or hammer moves in two directions that are not parallel to each other. It is therefore possible to use the abutment for securing as well as for releasing the firing pin which not only reduces the stroke of the trigger but also substantially reduces the number of parts. This double movement can also be split up between the abutment and firing pin or hammer.

The provision of an stop spring whose effect is opposite to that of the firing-pin spring means that only the difference between these forces need be overcome by force on the trigger to shoot.

In addition to these basic advantages the pistol according to this invention has several advantages. The rest position, for example, of the trigger is established by abutments 67 and 233 in the guide 45 or block 221, respectively, so that no particular stops for the trigger are needed. This eliminates expensive adjustment procedures. Since the parts necessary for the release and latching of the firing bolt can fit in a limited space, it is possible make the guide 45 or the block 221 relatively small. This leaves room in the frame 1 behind the hole for the cartridge clip. As a result, it is possible to have the grip near the axis A of the barrel 4 so that on firing there is little torsion on the hand. The pistol kicks up less so it shoots more accurately.

With the new pistol it is possible to form the spaces for mounting the trigger, trigger slide, and guides in the frame 1 by molding in such a manner that the frame 1 is easily demolded. The same applies for the clip hole and the passage for the clip-safety slide. As a result, the frame 1 can be made in one piece.

The guide for the slide in the frame 1 are made of metal. To do this it is sufficient to mount two guide rails which are imbedded in the frame 1 in the resin. They have the tongue and groove construction of FIG. 2.

Particularities of the described feature can be used independently of each other in pistols of known construction without losing the described advantages.

I claim:

1. In a pistol, including a frame having a longitudinal axis and a barrel mounted in the frame;

a slide mounted on the frame so as to be slidable forwardly toward the barrel into a closed position in which the slide is in contact with the barrel, and rearwardly out of a closed position, a recoil spring for biasing the slide into the closed position;

the slide including a breech block, the breech block closing off a cartridge chamber in the closed position of the slide;

a firing pin being mounted longitudinally movable in the breech block and having a nose projecting toward the frame, a firing pin spring for biasing the firing pin, the tension of the firing pin spring being releasable in a direction toward the barrel;

the frame further including a trigger mechanism with a trigger means and an abutment, the abutment being movable by the trigger means from an initial position initially parallel to the firing pin so that the firing pin nose engages the abutment and is moved and the firing pin spring is tensioned, the abutment being further movable in release direction until the abutment and the nose are disengaged;

the slide defining control means which during firing cause the abutment to be moved from the released position into the path of movement of the nose;

the improvement comprising, the frame including positive guide means serving for maintaining the abutment in the path of motion of the nose of the firing pin at least in a portion of the initial movement of the abutment parallel to the firing pin.

2. The pistol according to claim 1, wherein the frame comprises abutment guide means for effecting the movement of the abutment in the release direction; and wherein a guide edge of the abutment guide means projects into the path of the control means of the slide whereby, during the recoil of the slide, the control means dislodges the guide edge and thereby frees the abutment from the guide means for movement back into engagement with the firing pin nose.

3. The pistol according to claim 1, wherein the abutment is a projection on an abutment sleeve which is slidable in a longitudinal direction parallel to the firing pin and rotatable in a bore partially open in axial direction defined in the frame and is biased in a direction opposite the direction of biasing the firing pin spring by the stop spring;

an arm being attached to the abutment sleeve;

the guide means including a shoulder attached to the frame and a glide surface extending essentially perpendicular to the shoulder formed by the frame, wherein the abutment rests against the shoulder and the arm rests against the glide surface;

the trigger means being provided with a wedge surface engageable with the arm;

the trigger means being biased by a spring in the direction of the abutment;

the slide having a longitudinal median plane; the control means including a forward guide ridge; the slide further including a rearward guide ridge;

a guide edge arranged on the trigger means engageable with the rearward guide ridge lying outside of and adjacent the guide edge when the slide is in the closed position;

the distance between the outer surface of the forward guide ridge and the longitudinal median plane of the slide is greater than the distance between the radial end of the arm and the longitudinal median plane of the slide;

and a gap between the forward and the rearward guide ridge, the gap being wider than the length of the guide edge.

4. The pistol according to claim 1, wherein the trigger means comprises a lever having a slot extending in longitudinal direction thereof, a pivot pin attached to the frame extending through the slot, the lever being biased by an additional spring toward the slide;

the lever forming an abutment, the stop spring acting on the lever;

the guide means comprising a shoulder formed on the lever and a counter shoulder provided on the frame, the counter shoulder supporting the shoulder at least in the initial position of the lever to prevent movement of the lever away from the slide;

the trigger means having an end with a wedge surface;

a leaf spring attached to the frame, the leaf spring being displaceable transversely of the trigger means and having a guide edge engageable by the control means of slide;

a lever guide attached to the leaf spring and engageable by the wedge surface of the trigger means;

the slide having a longitudinal median plane, wherein the distance in a direction perpendicular to the median plane between the control means and the inner surface of the leaf spring is at least equal to the distance between the outer surface of the trigger means and the inwardly facing edge of the lever guide when the slide is in the closed position.

5. The pistol according to claim 1, the abutment being rigidly attached to the trigger means;

the guide means being formed by a recess defined in the trigger means and a projection attached to the frame projecting into the recess;

the recess having a narrow portion for effecting the movement of the abutment parallel to the firing pin and a wide portion for permitting the movement of the abutment in release direction;

a leaf spring attached to the frame, the leaf spring being displaceable transversely of the trigger means and having a guide edge;

the leaf spring further having a wedge surface, the trigger means having an inclined end surface engageable by the wedge surface of the leaf spring;

the stop spring being inclined relative to the longitudinal axis, so that the trigger means is biased by the stop spring toward the slide;

the guide edge engageable by the control means of the slide.

6. The pistol according to claim 1, the abutment being rigidly attached to the trigger means;

the guide means being formed by a recess defined in the frame and a projection attached to the trigger means projecting into the recess;

the recess having a narrow portion for effecting the movement of the abutment parallel to the firing pin and a wide portion for permitting the movement of the abutment in release direction;

a leaf spring attached to the frame, the leaf spring being displaceable transversely of the trigger means and having a guide edge;

the leaf spring further having a wedge surface, the trigger means having an inclined end surface engageable by the wedge surface of the leaf spring;

the stop spring being inclined relative to the longitudinal axis, so that the trigger means is biased by the stop spring toward the slide;

the guide edge engageable by the control means of the slide.

* * * * *

UNITED STATES PATENT AND TRADEMARK OFFICE

CERTIFICATE OF CORRECTION

PATENT NO. : 4,893,546

DATED : January 16, 1990

INVENTOR(S) : Gaston Glock

It is certified that error appears in the above-identified patent and that said Letters Patent is hereby corrected as shown below:

Title page:

Related U.S. Application Data

[63] Continuation of Ser. No. 773,352, Sept. 6, 1985, abandoned, continuation of Ser. No. 456,056, filed as PCT AT82/00015 on Apr. 29, 1982, Pat. No. 4,539,889.

Signed and Sealed this

Second Day of April, 1991

*Attest:*

*Attesting Officer*

HARRY F. MANBECK, JR.

*Commissioner of Patents and Trademarks*